US006486753B1

(12) United States Patent
Kim

(10) Patent No.: US 6,486,753 B1
(45) Date of Patent: Nov. 26, 2002

(54) METAL POST FILTER ASSEMBLY USING NON-RADIATIVE DIELECTRIC WAVEGUIDE

(75) Inventor: Young Su Kim, Ulsan (KR)

(73) Assignee: NRD Co., Ltd., Ulsan (KR)

( * ) Notice: Subject to any disclaimer, the term of this patent is extended or adjusted under 35 U.S.C. 154(b) by 0 days.

(21) Appl. No.: 09/983,173

(22) Filed: Oct. 23, 2001

(30) Foreign Application Priority Data

Jun. 19, 2001 (KR) ..... 01-34597

(51) Int. Cl.[7] ..... H01P 1/207
(52) U.S. Cl. ..... 333/208; 333/212
(58) Field of Search ..... 333/202, 208, 333/209, 210, 212

(56) References Cited

U.S. PATENT DOCUMENTS

| | | | | | |
|---|---|---|---|---|---|
| 2,629,015 | A | * | 2/1953 | Reed | 333/208 |
| 3,544,927 | A | * | 12/1970 | Elder et al. | 333/208 |
| 3,593,221 | A | * | 7/1971 | Reed | 333/208 |
| 3,602,847 | A | * | 8/1971 | Stagg | 333/122 |
| 4,812,789 | A | * | 3/1989 | Lee | 333/135 |
| 5,398,009 | A | * | 3/1995 | Kudo et al. | 333/208 |
| 6,331,809 | B1 | * | 12/2001 | Takakuwa et al. | 333/135 |

* cited by examiner

*Primary Examiner*—Seungsook Ham
(74) *Attorney, Agent, or Firm*—Nixon Peabody LLP; Thomas W. Cole

(57) ABSTRACT

Disclosed is a metal post filter assembly, of a millimeter wave band, using an NRD guide. A filter to which an electromagnetic wave travels is disposed in a filter housing which includes parallel conductive plates facing each other. The filter forms a plurality of inserting holes, by segmenting them into multi-stages, along the length direction of side surface of a dielectric line and parallel to the parallel conductive plates. The filter has a structure that multi-staged dielectric resonators are formed in a single body by inserting metal posts which provide discontinuous surfaces which cause a reflection with respect to the electromagnetic wave in each of the inserting holes. Each impedance of the multi-staged dielectric resonators has an impedance coupling relationship that the impedance becomes gradually and symmetrically smaller to both end stages. According to the impedance coupling relationship, a reflection amount of, and a transmission amount of, the electromagnetic wave traveling along the filter are properly determined. As a result, the filter provides a filtering function which selectively passes only a certain frequency band of the electromagnetic wave. The filter assembly is suitable for a commercial use due to its simple structure, a small loss and superiority in processing, assembly and productivity.

12 Claims, 12 Drawing Sheets

METAL POST FILTER ASSEMBLY USING NON-RADIATIVE DIELECTRIC WAVEGUIDE

BACKGROUND OF THE INVENTION

1. Field of the Invention

The present invention relates to a filter in a millimeter wave band, and more particularly to a millimeter wave band filter to which the technology of a non-radiative dielectric waveguide ("NRD guide") is applied.

2. Description of Prior Art

An NRD guide circuit has attracted attention as a transmission line for a micro wave band, particularly a millimeter wave band above 30 GHz, due to its small transmission loss in comparison with a microstrip line and due to its easiness in manufacturing the transmission line in comparison with prior waveguides.

The structure of a general prior NRD guide circuit is illustrated in FIG. 1. The NRD guide circuit has a structure that a dielectric line 10 through which an electromagnetic wave is transmitted is sandwiched between two parallel conductive plates 12*a,* 12*b* made from conductive metal. A space h of the two parallel plates 12*a,* 12*b* is less than half a free space wavelength of a using frequency. Accordingly, the electromagnetic wave is blocked in places other than the dielectric line 10 and its radiation is restricted, so that the NRD guide circuit can transmit the electromagnetic wave along the dielectric line 10 at a small loss. Paying attention to such transmission superiority of the NRD guide circuit, there have been proposed NRD guide filters of the 35 GHz and 50 GHz bands.

FIGS. 2 and 3 illustrate the structure of a prior air gap coupled filter using an NRD guide. The prior air gap coupled filter has a structure that multi-staged dielectric blocks are sandwiched between the parallel conductive plates 12*a,* 12*b*. One dielectric line is cut into multiple dielectric blocks with proper lengths. The dielectric blocks 14*a*~14*e* are straight aligned, with maintaining certain gaps therebetween, in the direction to which a signal proceeds and is air gap coupled with dielectric lines 10*a,* 10*b* on input and output sides, respectively. Each of the dielectric blocks operates as a dielectric resonator at each stage of the filter. The number of the dielectric resonator blocks is proportional to an order number of the filter. The air gap coupled filter shown in FIG. 2 is the fifth order filter because it has five dielectric resonator blocks 14*a*~14*e*.

The typical raw material for the dielectric line of the NRD guide which is applicable to millimeter waves is teflon. Teflon has an advantage that transmission loss is small whereas it has such disadvantages arising from its material characteristic that its processing is difficult due to its weakness and that its assembly is difficult because it does not easily adhere to other materials like metal. These disadvantages are the reason why the NRD guide has not been commercially used since the first introduction by Professor Yoneyama in the early 1980's.

Since the using frequency is as high as the millimeter wave band, a wavelength of the electromagnetic wave transmitted along the dielectric resonator blocks in the waveguide, i.e., within the parallel conductive plates, is very short. The characteristic of the filter, in this case, is sensitively changed in accordance with the physical dimensions of structural bodies and fixtures for setting the resonator. Thus, it is necessary not only that a length of each of the dielectric resonator blocks 14*a*~14*e* should be so accurately calculated as to be resonated at a certain frequency within a passing band, but also that each of the dielectric resonator blocks should be made as precisely as a predetermined length to obtain a wanted characteristic of the filter.

Further, each of the multi-staged dielectric resonator blocks 14*a*~14*e* should be spaced to maintain a proper gap apart from its adjacent dielectric resonator blocks. This gap should be determined to obtain an optimal impedance matching between the two adjacent resonator blocks. That is, in order to obtain a good characteristic of a designed filter, there should be a precision of several microns not only in the length of each of the dielectric resonator blocks 14*a*~14*e* but also in the distance between the resonators.

However, in manufacturing the prior air gap coupled filter using the NRD guide, it is difficult to make the dielectric resonator blocks 14*a*~14*e* have such a precision. And also, with maintaining the precision of several microns, it is difficult to align the dielectric resonator blocks 14*a*~14*e* which have different lengths in a straight line in the direction that a wave proceeds. In doing so, a lot of time and labor are required. Due to these reasons, the prior air gap coupled filter is a disadvantageous structure in terms of making, assembly and production, and is not suitable for a commercial model which is applicable to a high frequency in the millimeter wave band.

That is, in the case of the prior NRD guide air gap coupled filter, the resonator of each stage exists as a single independent block having a different length from one another, and has a structure that an impedance of each stage is controlled by adjusting a distance between each resonator. In this kind of structure, it is difficult to precisely make the dielectric resonators and to align the independent block of each stage in the right position within the filter housing with maintaining a predetermined distance.

SUMMARY OF THE INVENTION

In order to improve the above problems, an object of the present invention is to provide a metal post filter assembly, using an NRD guide, which is designed for an easy making and a good productivity resulting from a convenient and accurate assembly and is capable of stably having filter characteristics to a wanted degree.

To accomplish the object of the present invention, there is provided a metal post filter assembly using a non-radiative dielectric waveguide, comprising: a filter housing which includes parallel conductive plates facing each other; and a filter, disposed between said parallel conductive plates, for filtering a certain frequency band of a traveling electromagnetic wave, said filter including, a single body type dielectric line, made from a non-radiative dielectric, whose side surface is formed with a plurality of inserting holes running parallel to said parallel conductive plates, said dielectric line being segmented into multi-stages by one or more sets of said inserting holes which are spaced apart by a predetermined distance along a length direction of said dielectric line, and the number of the sets corresponding to a filtering order of said filter assembly, and a plurality of metal posts, each of which having a diameter to be fittingly inserted in each of said inserting holes.

The filter is formed with multi-staged dielectric resonators cascaded as a single body and segmented by said metal posts, said multi-staged dielectric resonators providing a filtering function which selectively allows only the certain frequency band of the traveling electromagnetic wave to pass therethrough by a predetermined impedance coupling relationship. It is particularly preferable that an impedance of said multi-staged dielectric resonators is largest in a middle stage and becomes gradually and symmetrically smaller to both end stages. Further, it is preferable that a length of said multi-staged dielectric resonators is longest in a middle stage and becomes gradually and symmetrically shorter to both end stages.

According to one preferred embodiment of the filter, one inserting hole is formed per each stage on the side surface of said dielectric line, said inserting hole in each stage having a diameter which is largest in the middle stage and becomes gradually and symmetrically smaller to both end stages and being disposed along an approximately half-height of said side surface in line.

According to another preferred embodiment of the filter, two inserting holes whose diameters are identical are disposed, per each stage, above and below an approximately half-height point of said side surface of said dielectric line and a vertical distance of said two inserting holes in each stage is narrowest in the middle stage and becomes gradually and symmetrically wider to both end stages.

According to a third preferred embodiment of the filter, one or more inserting holes are formed per each stage on said dielectric line, the number of, and diameters of, the inserting holes in each stage being determined in the manner that a reflection rate in each stage against the electromagnetic wave traveling through said dielectric line is highest in the middle stage and becomes gradually and symmetrically lower to both end stages.

The metal window filter assembly further comprises a plurality of tuning screws inserted, parallel to said metal posts toward said dielectric line, through both side walls of said filter housing, for tuning a resonance frequency of the filter by adjusting insertion lengths of said tuning screws.

According to the metal post filter of the present invention, the filter can be made by forming the inserting holes in the dielectric line made from a material which is difficult for being processed, and the dielectric resonators having the desired number of stages can be made as a single body by inserting the metal posts in the inserting holes. And also, the filter assembly is easily assembled by inserting the filter between the upper and lower conductive plates of the filter housing.

Therefore, the filter assembly according to the present invention can remarkably maximize production efficiency and reduce manufacturing costs due to its simple structure and superiority in the processing and assembling thereof. Further, since the filter assembly of the present invention is designed to minimize the factors of error occurrence during its assembly, it has advantages of maintaining the precision of the processing machine for the filter structure of the millimeter wave band which requires the precision of several microns and of accurately maintaining the characteristic of the filter to the designed level as it can be assembled without an extra auxiliary zig.

Other characteristics and advantages of the present invention will become more apparent by describing in detail preferred embodiments thereof with reference to the accompanying drawings.

BRIEF DESCRIPTION OF THE DRAWINGS

The detailed description relating to the preferred embodiments of the present invention will be made with reference to the accompanying drawings.

DETAILED DESCRIPTION OF THE PREFERRED EMBODIMENTS

FIGS. 4 to 10 illustrate a structure of a metal post filter according to the first embodiment of the present invention.

Figure 1:
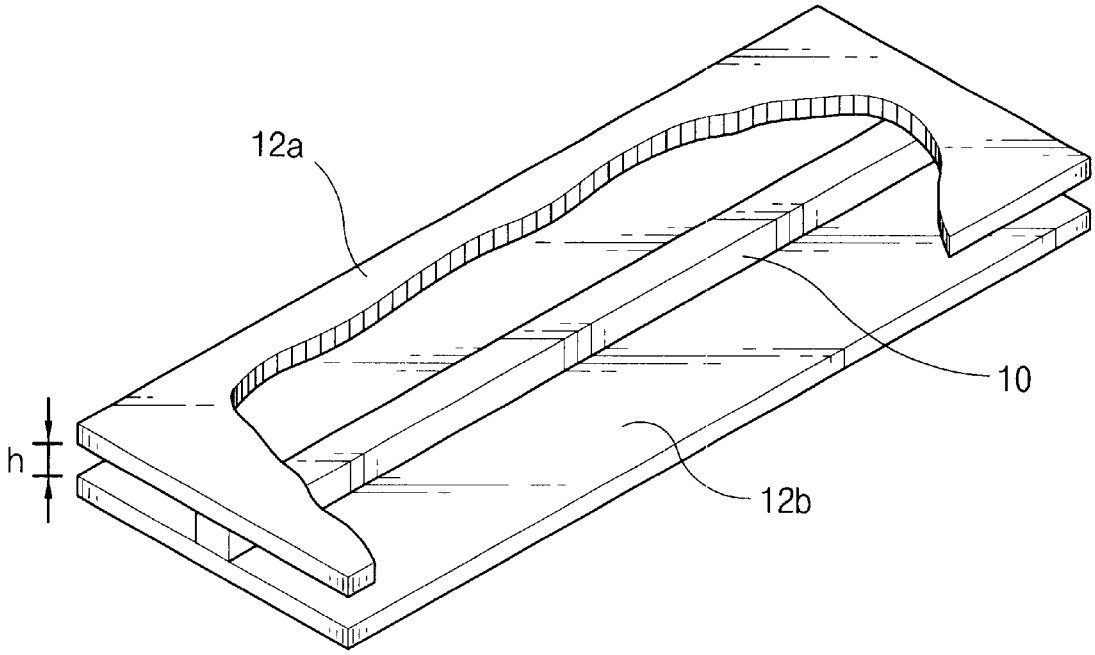
FIG. 1 (PRIOR ART)
FIG. 1 is a perspective view illustrating a structure of an NRD guide.
Figure 2:
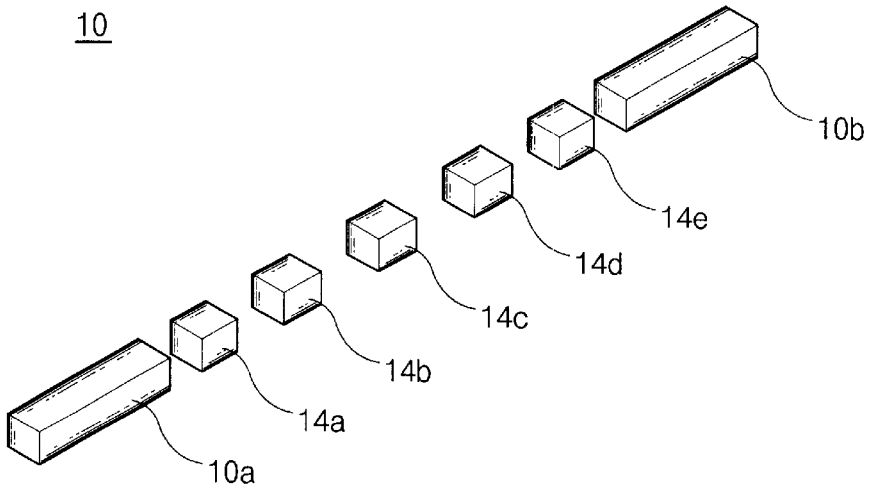
FIG. 2 (PRIOR ART)
FIG. 2 is a perspective view illustrating a dielectric line of a prior air gap coupled filter using the NRD guide and a connecting manner of each of dielectric resonators.
Figure 3:
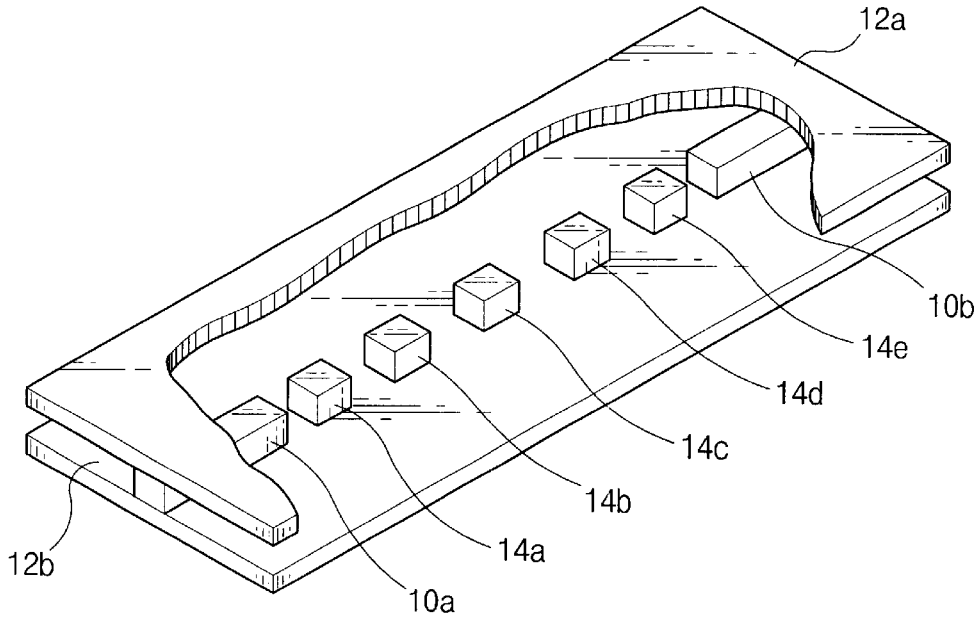
FIG. 3 (PRIOR ART)
FIG. 3 is a perspective view illustrating a structure of the prior air gap coupled filter using the NRD guide.
Figure 4:
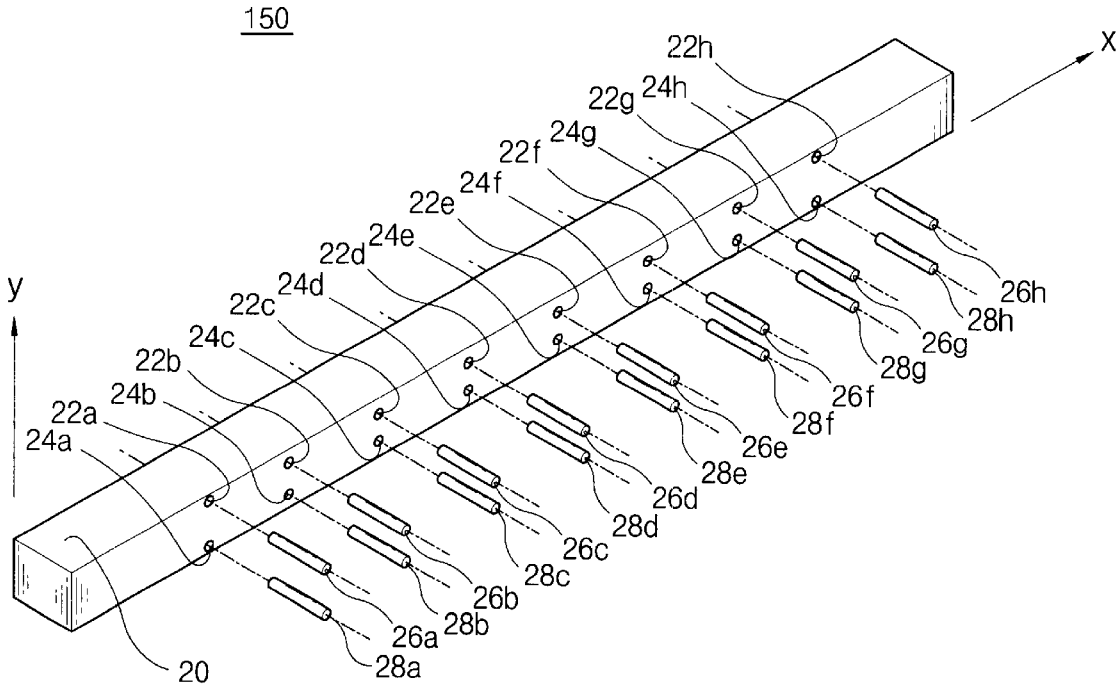
FIG. 4 illustrates a structure of a filter, as a filter of a metal post filter assembly according to the first embodiment of the present invention, in which a dielectric line formed in a single body is segmented into multi-stages by plural pairs of upper and lower holes, into which a plurality of metal posts having a uniform thickness are correspondingly inserted in each stage in pairs, spaced along side surfaces of the dielectric line.

FIG. 4 illustrates a filter 150 of the metal post filter according to the first embodiment. The filter 150 comprises a single body type dielectric line 20 and a plurality of metal posts 26*a*~26*h*, 28*a*~28*h*.

A plurality of metal post inserting holes 22*a*~22*h*, 24*a*~24*h* are formed on side surfaces of the dielectric line 20 along the width direction (the x-axis direction). These inserting holes are so spaced in the x-axis direction by the predetermined distance as to form multi-stages. Two inserting holes per each stage are disposed, in the y-axis direction, respectively, above and below an approximately half-height point of said side surface of said dielectric line 20. In arraying the inserting holes, the space between adjacent pairs of the inserting holes in the x-axis direction becomes gradually wider to the middle stage, and the space within each pair thereof in the y-axis direction becomes gradually narrower to the middle stage. However, when a frequency band to be filtered is determined, it is necessary to precisely calculate the accurate spaces of the inserting holes on the x- and y-axis directions via a design equation based on the determined value of the frequency band. Each of the metal posts 26*a*~26*h*, 28*a*~28*h* is inserted in each of the inserting holes 22*a*~22*h*, 24*a*~24*h*. As a result, there is prepared the filter 150 having multi-staged dielectric resonators coupled on the dielectric line as a single body.

The number of stages of the inserting holes formed on the dielectric line 20 is proportional to a filtering order of the filter. Since the filter 150 illustrated in FIG. 4 has a structure that the dielectric line 20 is segmented by eight pairs of the inserting holes and the seven resonator blocks are cascaded in a single body, the filter 150 becomes the seventh order band pass filter. The number of the inserting holes and the metal posts can be determined in correspondence to a wanted filtering order.

The metal windows 26*a*~26*h*, 28*a*~28*h* can be made either from metal only or as a structure that the exterior of an inner post is coated with metal having a superior conductivity over the inner post which is made from a certain material like synthetic resin or steel. In the latter, a thickness of the metal-coated stage shall be designed to be more than at least a skin depth. The example of a preferred material for manufacturing the metal windows is silver, copper, gold or aluminum which has a superior conductivity. The skin depth is not a fixed value, but a value which is determined according to the using frequency and the conductive characteristic of metal. The skin depths of silver and gold at a frequency band of 39 GHz are approximately 0.325 $\mu$m and 0.398 $\mu$m, respectively.

In the filter 150, the dielectric line between a pair of the two adjacent metal posts, for example, a pair of the metal posts 26*c*, 28*c* and a pair of the metal posts 26*d*, 28*d*, operates as a dielectric resonator of each stage of the filter and corresponds to the dielectric resonator block of the prior air gap coupled filter. The dielectric resonators of the seven stages, i.e., the first dielectric resonator between the inserting holes 22*a*, 22*b*, the second dielectric resonator between the inserting holes 22*b*, 22*c*, the third dielectric resonator between the inserting holes 22*c*, 22*d*, the fourth dielectric resonator between the inserting holes 22*d*, 22*e*, the fifth dielectric resonator between the inserting holes 22*e*, 22*f*, the sixth dielectric resonator between the inserting holes 22*f*, 22*g* and the seventh dielectric resonator between the inserting holes 22*g*, 22*h*, are cascaded as a single body. As a result, the space between the dielectric resonators can be maintained as precisely as the accuracy (several microns) of a processing machine, accordingly a difficulty in spacing the dielectric resonators in the right position during the assembly of the prior air gap coupled filter can be remarkably improved.

Meanwhile, as shown in FIG. 4, the positions of the metal posts are identical with the positions of the inserting holes. Therefore, the pair of the metal posts 26*d*, 28*d* or 26*e*, 28*e* at the middle stage have a narrow vertical distance on the y-axis, and the pair of the metal posts at each stage become to have a gradually wider vertical distance on the y-axis to both end stages. The distribution of the electromagnetic wave traveling the dielectric resonator of each stage is denser at the center of the dielectric resonators whereas it becomes sparser towards the outside. The metal windows are interposed horizontally against the traveling direction of the electromagnetic wave along the dielectric line 20, so that they provide discontinuous surfaces which cause wave reflection. Accordingly, the closer the metal posts are disposed to the center of each of the dielectric resonators, the larger an impedance value of each of the dielectric resonators becomes. The farther the metal posts are disposed from the center of each of the dielectric resonators, the smaller an impedance value of each of the dielectric resonators becomes. According to the disposition of the metal posts as shown in FIG. 4, the respective impedance values of the seven dielectric resonators, for example, 110Ω, 130Ω, 160Ω, 200Ω, 160Ω, 130Ω and 110Ω, become gradually and symmetrically bigger to the middle stages. The electromagnetic wave is more reflected at the dielectric resonator of the middle stage whereas it is less reflected at the dielectric resonators of both end stages. Likewise, when the electromagnetic wave traveling along the dielectric line 20 meets the discontinuous surface according to the metal posts, reflection and loss happen in the electric field by a certain amount and the electromagnetic wave proceeds to the dielectric resonator of the next stage. After all, if the impedance value of each dielectric resonator is properly adjusted based on the disposed distance of the metal posts, a band pass filter which selectively passes a certain band of frequency will be obtained. In general, major factors which affect the impedance value of each dielectric resonator are the disposed position, number, dimensions, conductivity and external shape of the metal post. Therefore, a filter capable of filtering a wanted frequency component can be designed by applying such factors as proper values.

In sizing the respective lengths, in the x-axis direction, of the dielectric resonators, it is preferable that the middle stage, i.e., the fourth dielectric resonator, has the longest length, and each of the rest becomes gradually shorter to both end stages. The reason is that, since an impedance of each dielectric resonator becomes gradually and symmetrically smaller to both end stages and, as a result, a phase difference of the electromagnetic wave occurs, it is considered to compensate the phase difference of the electromagnetic wave by gradually shortening the length of each dielectric resonator to both end stages.

In the second and third embodiments which will be described later, a wanted filter characteristic can be designed, based on the above principle, by applying a slightly additional consideration to determining diameters of the metal posts and the number of the metal post of each stage.

According to a design system that the inserting holes 22*a*~22*h*, 24*a*~24*h* are arranged with multi-stages and a pair of the inserting holes at each stage are arrayed in length, the filtering frequency band can be so controlled by adjusting the spaces in the x- and y-axis directions as to have an identical diameter for the inserting holes 22*a*~22*h*, 24*a*~24*h*. After all, the metal posts 26*a*~26*h*, 28*a*~28*h* can be made to have an identical size. The fact that the inserting holes and the metal posts have an identical size, respectively, operates advantageously in increasing a manufacturing productivity. It means that when the inserting holes of the dielectric line 20 are cut by a milling machine, the cutting is possible by one tool kit without exchanging it with another wool kit. And also, in the making of the holes of the dielectric line, the manufacturing time is remarkably reduced because the dielectric line can be entirely made in one surface. By designing the inside of the inserting holes not to have any discontinuity, the dielectric line 20 on which the inserting holes are formed can be easily manufactured by injection molding or extrusion molding.

Figure 5:
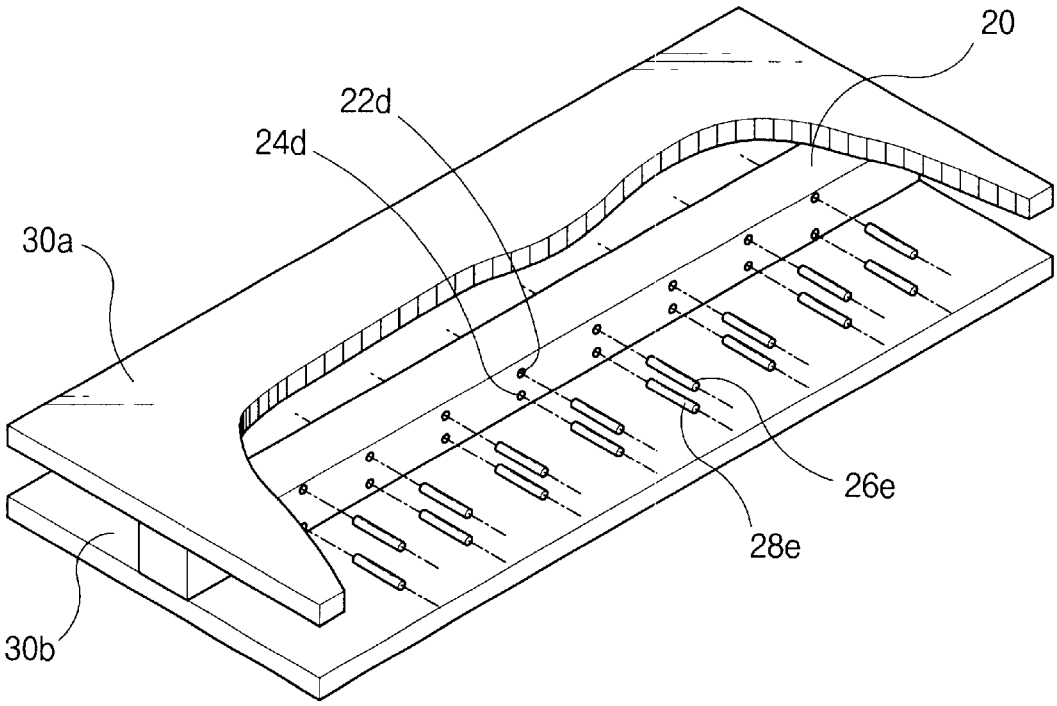
FIG. 5 illustrates structures of major parts of the filter assembly according to the first embodiment of the present invention and is, in particular, a cut-open perspective view explaining a feature that the filter of FIG. 4 which is made as a single body type is sandwiched between upper and lower parallel conductive plates.

FIG. 5 illustrates structures of major parts of the filter assembly according to the first embodiment of the present invention and is, in particular, a cut-open perspective view explaining a feature that the filter 150 of FIG. 4 which is made as a single body type is sandwiched between the upper and lower parallel conductive plates 30*a,* 30*b.* As illustrated, the metal post filter is a structure that the single body type dielectric filter 150 in which the metal posts 26*a*~26*h,* 28*a*~28*h* are inserted is simply sandwiched between the conductive plates 30*a,* 30*b,* so that a possibility that the filter characteristic is changed by an additional assembling error which may arise during assembly can be fundamentally excluded. Accordingly, the filter assembly of the present invention has advantages that it can maximize the manufacturing productivity due to a manufacturing convenience and a shortened assembling time and, at the same time, the filter characteristic can be maintained to the designed level.

Figure 6:
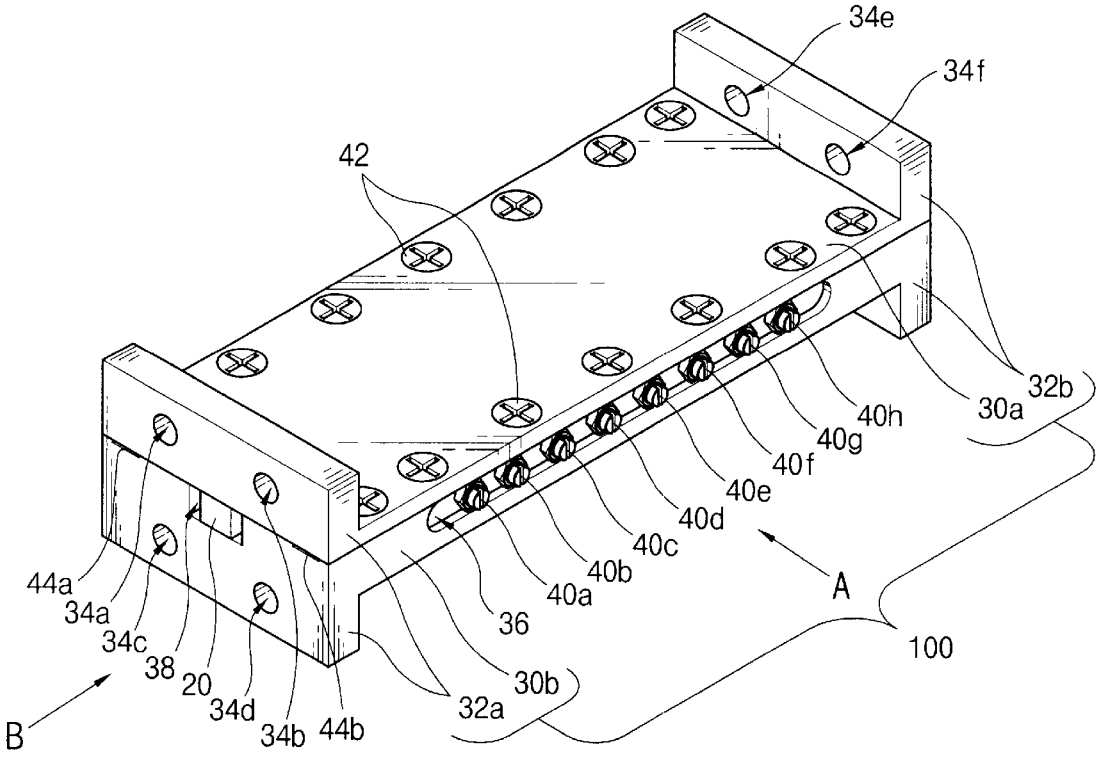
FIG. 6 is a perspective view showing that the exterior of the metal post filter assembly according to the present invention.

FIG. 6 is a perspective view showing that the exterior of a metal post filter assembly according to the present invention. The metal post filter assembly is made as a structure that the filter 150 is inserted in the filter housing 100. FIG. 5 is a view illustrating parts of the filter assembly of FIG. 6. The filter housing 100 includes the upper and lower conductive plates 30*a,* 30*b* in which a plurality of coupling holes 42' are formed. A plurality of bolts 42 bolt the holes 42'. As a result, the filter 150 is fixed between the upper and lower conductive plates 30*a,* 30*b.*

Both ends of the upper and lower conductive plates 30*a,* 30*b* have a structure that vertically extended flanges 32*a,* 32*b* are integrated with the plates as a single body. A plurality of holes 34*a*~34*d,* 34*e*~34*f* for being coupled with different devices, for example, standard rectangular waveguide devices, are formed in both sides of the flanges 32*a,* 32*b,* respectively.

It is preferable that a plurality of tuning screws 40*a*~40*h,* 40*a*'~40*h*' for tuning the resonance frequency of each stage of the dielectric resonator are inserted through both sides of the filter housing 100. For doing so, a nut inserting area 36 for fastening the tuning screws is prepared on the sides of the filter housing 100, and a plurality of holes are formed to insert the tuning screws 40*a*~40*h,* 40*a*'~40*h*' in the nut inserting area 36. In comparison with the prior filter, the filter assembly according to the present invention can remarkably reduce an error occurring during the processing and/or assembling works. Nonetheless, it may be inevitable for the filter assembly to have a minute error compared with its design criteria. Therefore, the tuning screws 40*a*~40*h,* 40*a*'~40*h*' are adopted to compensate to a maximum degree even a minute error which may arise during the processing and assembling of the filter 150 and the filter housing 100. The tuning screws are disposed parallel to, that is, transversely to the traveling direction of the electromagnetic wave, the parallel conductive plates 30*a,* 30*b.* By means of changing a forming pattern of the electric field by adjusting an inserting length of the tuning screws, the tuning screws can compensate errors, which may be introduced during the processing and/or assembling works, in several parameters of the filter assembly.

Figure 7:
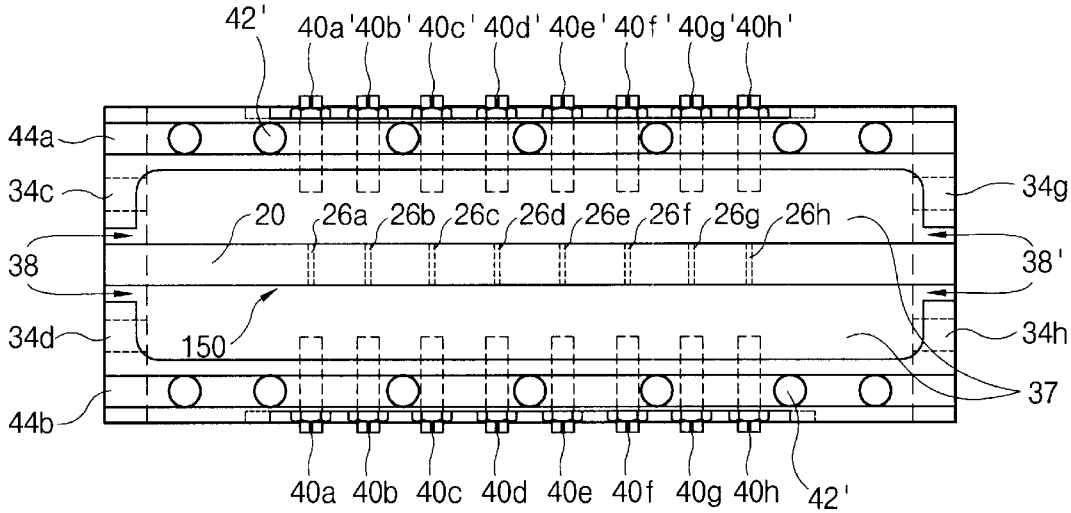
FIGS. 7 and 8 are a plan view and a perspective view respectively illustrating a state that the upper conductive plate is so removed as to explain the structure of the filter assembly illustrated in FIG. 6, a tuning point and a tuning method.
Figure 8:
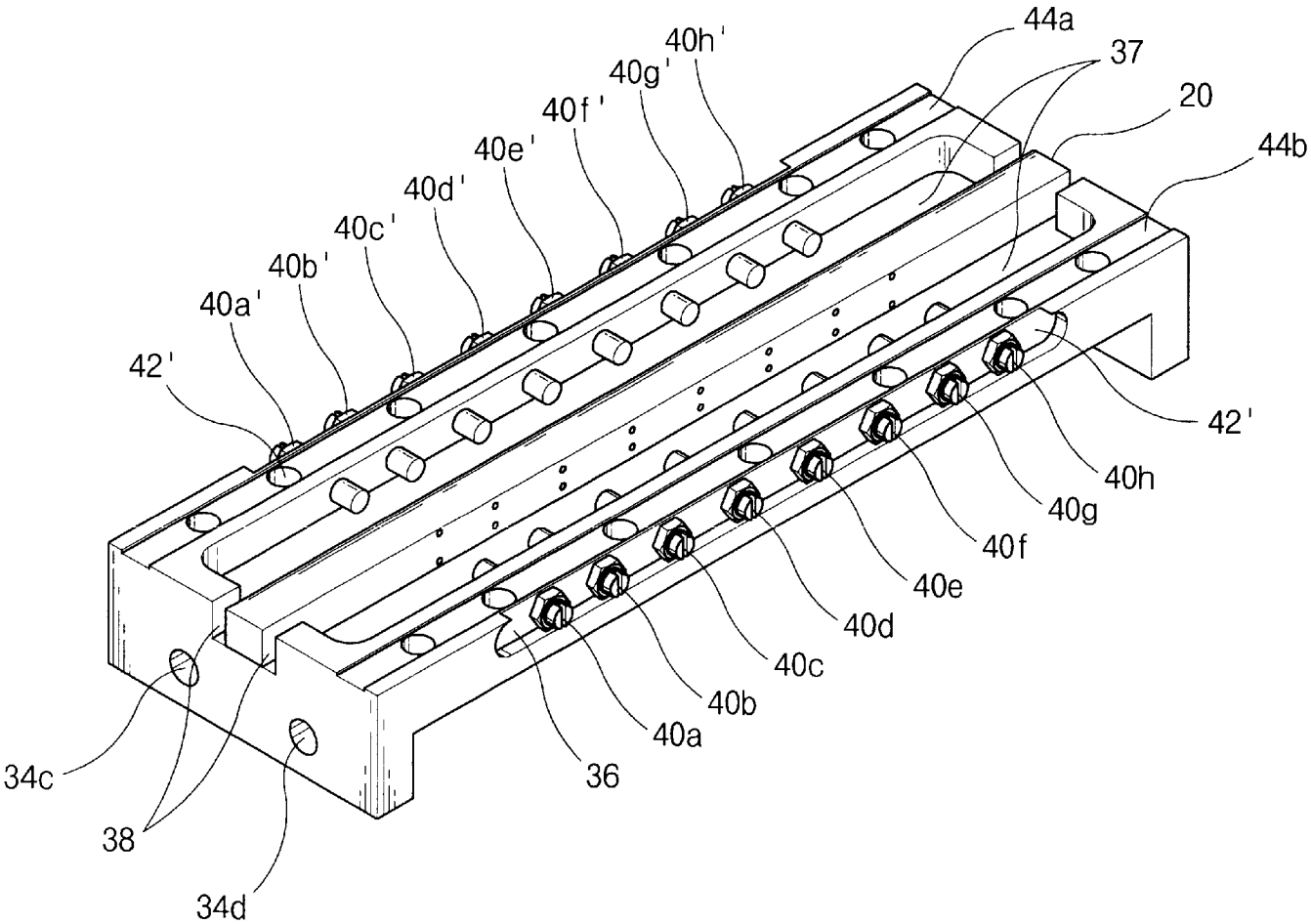
Figure 9:
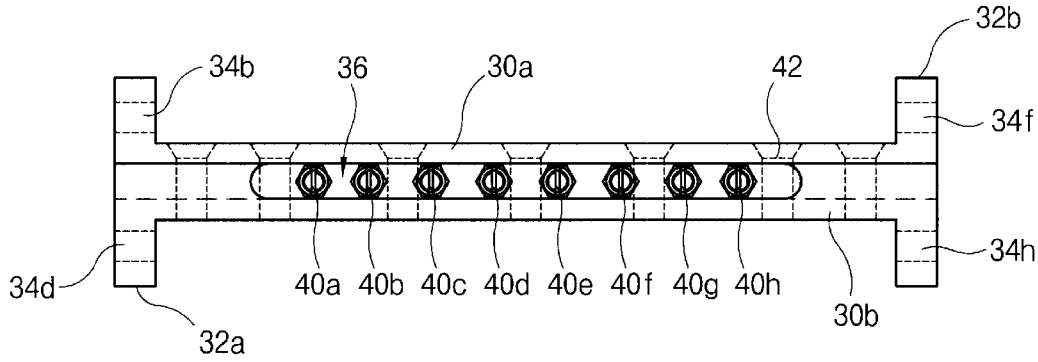
FIGS. 9 and 10 are respectively a front view of, and a side view of, the filter assembly of FIG. 6 when viewed in the A direction.

FIGS. 7 and 8 are a plan view and a perspective view, respectively, illustrating a state in which the upper conductive plate 30*a* is removed from the filter assembly illustrated in FIG. 6. At the top of the lower conductive plate 30*b,* an inner space 37 of a substantially rectangular shape defined by four sidewalls is provided in the center thereof. Openings 38, 38' are formed on the two sidewalls, facing each other, of the inner space 37. The filter 150 in which the metal posts 26*a*~26*h,* 28*a*~28*h* are inserted is disposed across the center of the inner space 37 of the lower conductive plate 30*b,* and its both ends are aligned with the ends of the openings 38, 38'. The tuning screws 40*a*~40*h,* 40*a*'~40*h*' are disposed at both sides of the filter 150. It is preferable to design that the tuning screws 40*a*~40*h,* 40*a*'~40*h*' are inserted in and fixed on the two remaining sidewalls of the inner space 37 and that each tuning screw points a vertical middle point between two metal posts of each stage of the filter 150. FIG. 9 which is a front view of the filter assembly of FIG. 6 when viewed in the A direction shows that the centers of the tuning screws 40*a*~40*h* are positioned in the center of the upper and lower conductive plates is 30*a,* 30*b,* i.e., in the middle height of the dielectric line 20.

Of course, it may be allowed to position each of the tuning screws in the center of the dielectric resonator at each stage, i.e., in the center between two adjacent pairs of the metal posts. In comparison with the latter method, the former method is advantageous in that the frequency tuning is well done with a shallow insertion depth. The latter method can reduce the number of the tuning screws whereas it has a difficulty in frequency tuning because the characteristic of the filter varies so sensitively by the inserting length of the tuning screws.

Meanwhile, although the upper and lower conductive plates 30*a,* 30*b* are firmly assembled via screw coupling, they have a minute crack existing between them. In order to block a leakage of the electromagnetic wave through the minute crack, it is preferable to form wave leakage blocking grooves on around the outer circumference of the upper and/or lower conductive plates 30*a,* 30*b.* It is preferable that a width of the grooves is approximately $\lambda/4$ (where $\lambda$ is a wavelength of the electromagnetic wave). The wave leakage blocking grooves can reduce a transmission loss of the filter. FIGS. 6 and 7 show examples that the wave leakage blocking grooves 44*a,* 44*b* are formed on the two sidewalls of the inner space 37 of the lower conductive plate 30*b.*

Figure 10:
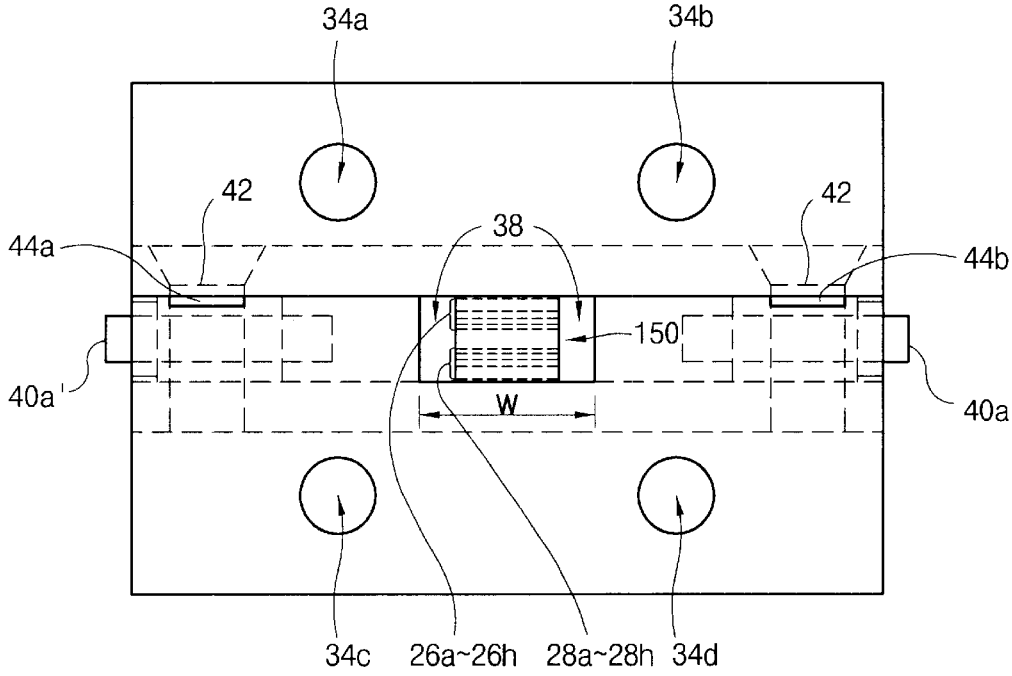

FIG. 10 is a side view viewed from an input/output port of the filter assembly, i.e., in the B direction of FIG. 6. It is preferable to design the flanges 32*a,* 32*b* and their coupling holes 34*a*~34*d,* 34*e*~34*f* to the effect that the input/output port of the filter assembly is interchangeable with the widely used standard rectangular waveguide (not shown). In order for the input/output port of the filter 150 to have a precise impedance matching with an input or output port of the standard rectangular waveguide, it is particularly preferable to prepare a marginal space for adjusting a setting position by making a width W of the openings 38, 38' formed on the flanges 32*a,* 32*b* wider than a width of the filter 150.

Figure 11:
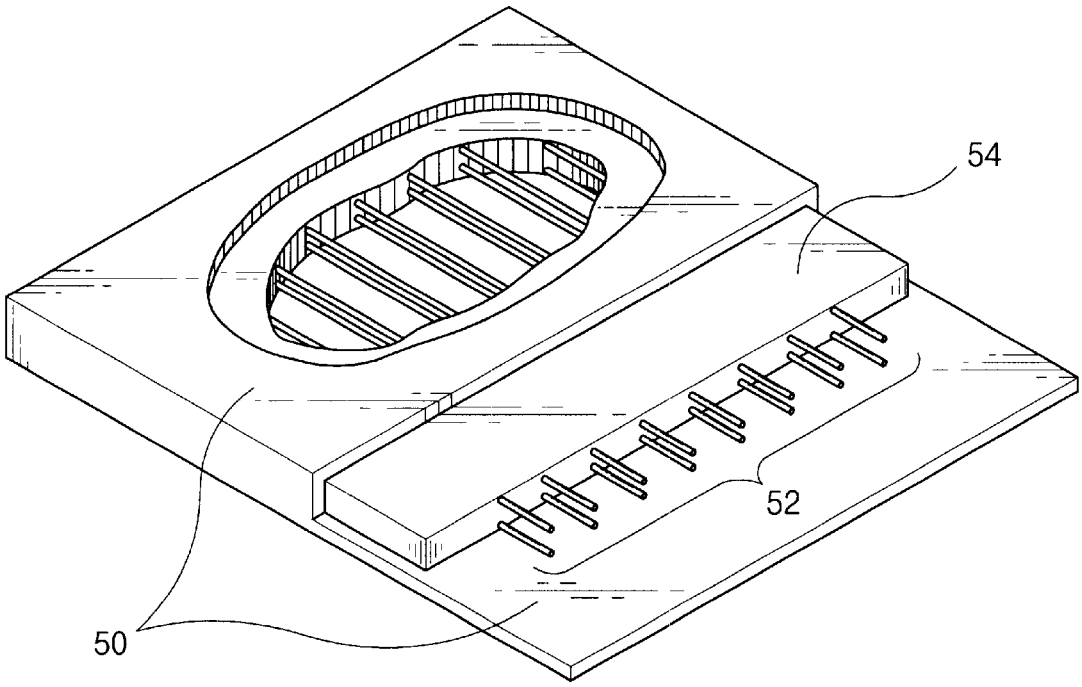
FIG. 11 is a manufacturing process cut-open view illustrating that a single body type dielectric line on which metal post inserting holes are formed can be manufactured by injection molding or extrusion molding.

Meanwhile, the filter 150 according to the first embodiment can be manufactured by such various methods as injection molding, extrusion molding, milling processing, and the like. FIG. 11 illustrates a manufacturing process of the filter 150 and the single body type dielectric line 20 on which the inserting holes are formed by injection molding or by extrusion molding.

In the case that the filter 150 is manufactured by injection molding, a mold 50 in which a plurality of metal sticks 52 are disposed in the position that its inner surface matches with the metal post inserting holes of the filter is first manufactured. After the mold 50 is manufactured, when a dielectric material is injected into the mold 50 and is cooled in the mold, a plate-shaped dielectric 54 formed with the inserting holes in which the metal windows are inserted is manufactured. In the case of extrusion molding, after powder of a dielectric material is stuffed into a prepared mold 50 as above and is undergone pressing and forming processes etc., a plate-shaped dielectric body 54 formed with the inserting holes in which the metal posts are inserted is also manufactured. In the case of processing via a milling machine, holes are accurately formed in the right position by a drill having a measurement identical with diameters of the holes to be formed on a plate-shaped dielectric material. Any one among the above manufacturing methods can be used for mass production.

Figure 12:
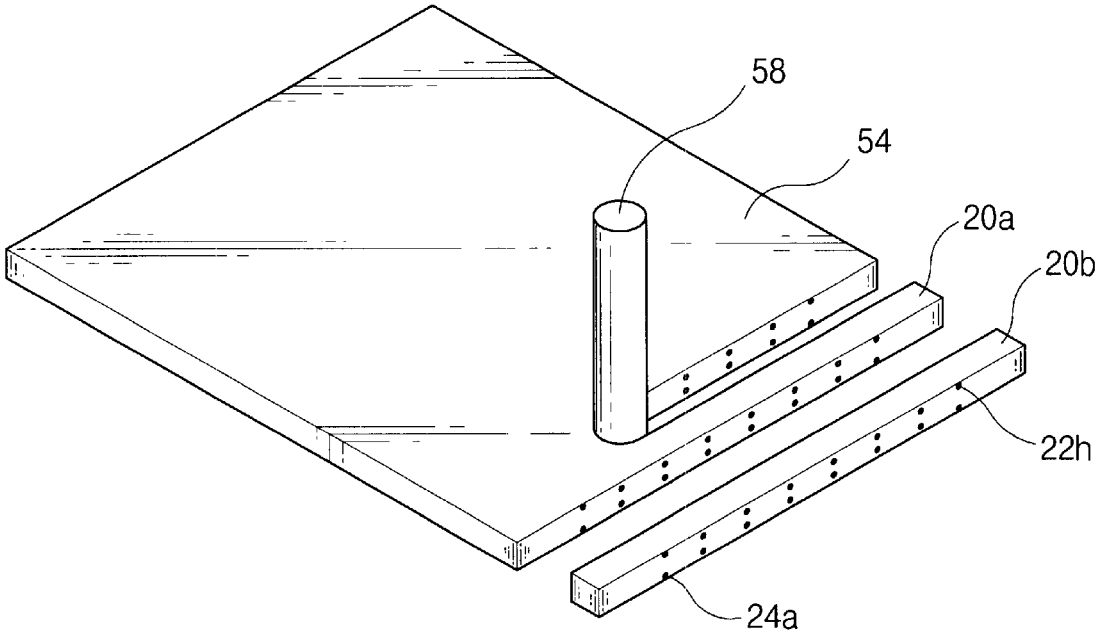
FIG. 12 is a feature illustrating that a plate-shaped dielectric on which the inserting holes manufactured or processed by the process of FIG. 11 are formed is cut by a milling machine by the regular width.

After the plate-shaped dielectric 54 based on the above methods is manufactured, a plurality of dielectric lines 20*a*, 20*b* . . . in a rectangular stick shape can be obtained by cutting the plate-shaped dielectric 54 by a wanted width with a cutting machine such as a milling machine. FIG. 12 shows a feature that the plate-shaped dielectric 54 on which the inserting holes are formed is cut by a milling machine 58 by the regular width. Since many dielectric lines 20*a*, 20*b* . . . can be obtained at once from the plate-shaped dielectric 54, this fact also confirms that the filter assembly according to the present invention has a superior productivity.

Of course, the filter 160 or 170 according to the below-mentioned second and third embodiments can also be manufactured or processed by the above methods.

Figure 13:
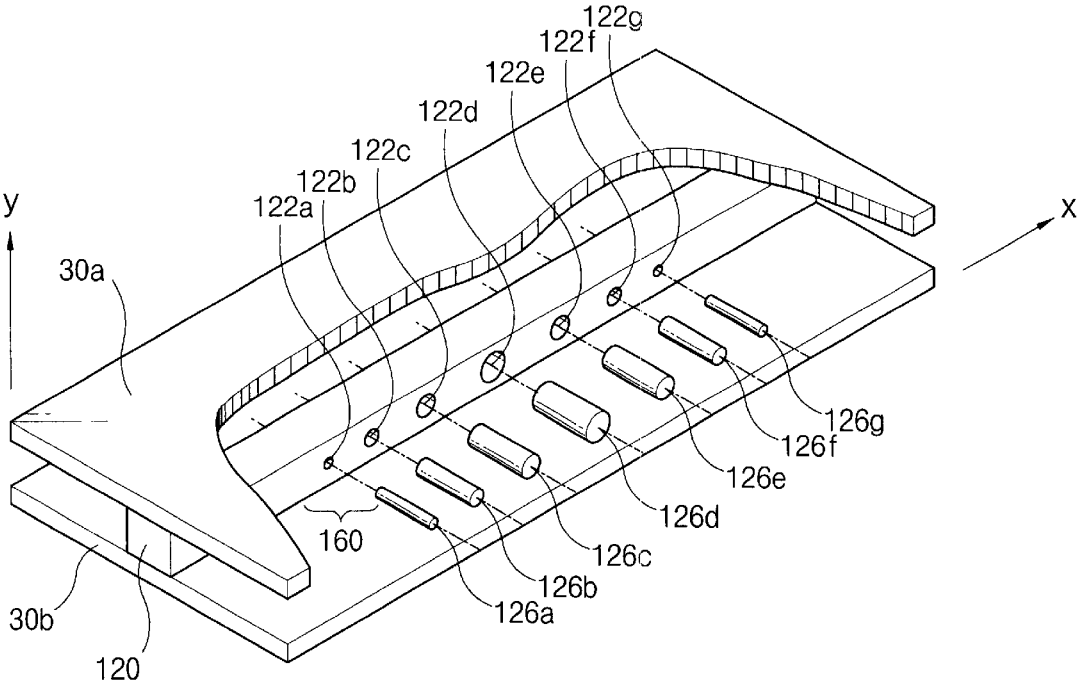
FIG. 13 illustrates a configuration of the major parts of the filter assembly according to the second embodiment of the present invention, and is a cut-open view illustrating the major structure of the filter assembly that the dielectric line formed in a single body is segmented into multi-stages by a plurality of holes spaced along side surfaces of the dielectric line, one metal post is inserted into a hole of each stage, and diameters of the holes and the metal posts become symmetrically and gradually larger to the middle stage.

FIG. 13 illustrates a configuration of the major parts of the filter assembly according to the second embodiment of the present invention, and is a cut-open view illustrating the major structure of the filter assembly that the dielectric line formed in a single body is segmented into multi-stages by a plurality of holes spaced along side surfaces of the dielectric line, one metal post is inserted into a hole of each stage, and diameters of the holes and the metal posts become symmetrically and gradually larger to the middle stage. FIG. 13 is a view corresponding to FIG. 5.

According to the first embodiment, the dielectric line 20 is formed with a pair of the upper and lower metal post inserting holes having an identical diameter at each stage, so that diameters of all the metal posts are designed to be identical. In comparison with the first embodiment, according to the second embodiment, the metal post inserting holes 122*a*~122*g* formed on the dielectric line 120 are formed in each stage one by one, and the diameters of the inserting holes and the metal posts are designed to be different from each other.

FIG. 13 illustrates the filter 160 comprising a band pass filter which is the sixth order filter. According to the filter 160, the centers of the inserting holes 122*a*~122*g* are positioned in the middle height (on the basis of the y-axis) of the dielectric line 120. The diameter of the inserting hole 122*d* of the middle stage is biggest and the diameters of the remaining inserting holes become gradually and symmetrically smaller to both end stages. The diameters of the metal posts 126*a*~126*g* are determined in this way. By doing so, impedances of the dielectric resonators become gradually and symmetrically greater to the middle stage as explained in the first embodiment. As in the first embodiment, the distance of the metal posts is widest in the middle stage and the distances of the remaining metal posts become gradually and symmetrically narrower to both end stages.

The structure of the filter housing 100 and the coupling relationship between the filter 160 and the filter housing 100 are almost same as in the first embodiment. In arranging the tuning screws, the center of each of them is preferably aligned with the center of each of the metal posts.

Figure 14:
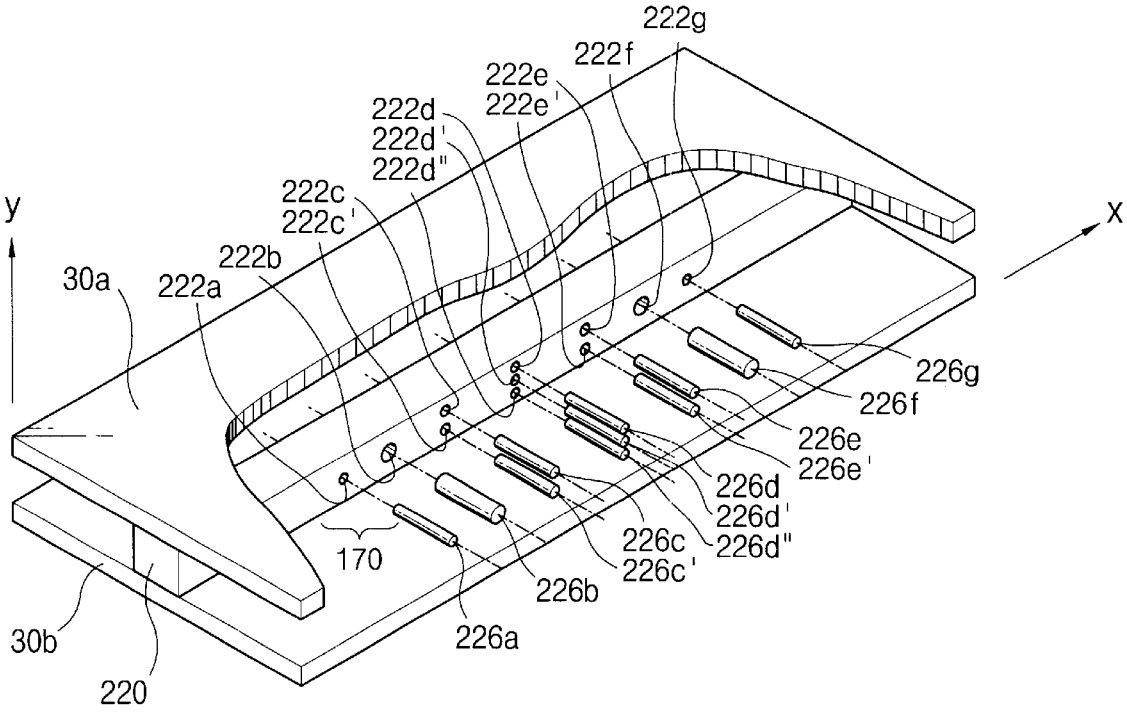
FIG. 14 illustrates a configuration of the major parts of the filter assembly according to the third embodiment of the present invention, and is a cut-open view illustrating the major structure of the filter assembly that the dielectric line formed in a single body is segmented into multi-stages by multi-sets of holes spaced along side surfaces of the dielectric line, one or more metal posts are inserted into each set of holes one to one, and diameters of the holes and the metal posts are not uniform.

FIG. 14 illustrates a configuration of the major parts of the filter assembly according to the third embodiment of the present invention, and is a cut-open view illustrating the major structure of the filter assembly that the dielectric line formed in a single body is segmented into multi-stages by multi-sets of holes spaced along side surfaces of the dielectric line, one or more metal posts are inserted into each set of holes one to one, and diameters of the holes and the metal posts are not uniform. FIG. 14 is a view corresponding to FIG. 5 or 13.

In comparison with the first and second embodiments, according to the third embodiment, the metal post inserting holes 226*a*~226*g* formed on the dielectric line 220 are formed more than one in each stage, and the diameter of the inserting hole of each stage and the diameter of each of the metal posts 226*a*~226*g* are designed to be different from each other.

FIG. 14 illustrates a filter 170 comprising a band pass filter which is the sixth order filter. According to the filter 170, it is difficult to find any regularity of the inserting hole and the metal post of each stage in number and diameter. However, the number and diameter of the metal post of each stage can be determined based on the above-mentioned principle of the first embodiment.

When the electromagnetic wave travels along the dielectric line 220, its distribution becomes denser towards the center of the dielectric line 220. According to the example of the arranged positions and diameters of the metal posts shown in this embodiment, the three metal posts 226*d*, 226*d*', 226*d*", though the diameter of each of them is small, are disposed in the middle stage densely and closely to the center of the dielectric line 220 so that a large impedance can be obtained in the dielectric resonator of the middle stage. And also, in third and fifth stages, two sets of the metal posts 226*c*, 226*c*' and 226*e*, 226*e*' are inserted in the corresponding sets of inserting holes 222*c*, 222*c*' and 222*e*, 222*e*', respectively. Their diameters are approximately identical with those of the metal posts of the middle stage. Further, in both end stages and in the second and sixth stages, two sets of the metal posts 226*a*, 226*b* and 226*f*, 226*g* are inserted in the two corresponding sets of inserting holes 222*a*, 222*b* and 222*f*, 222*g*, respectively. The diameters of the metal posts 226*a*, 226*g* in both end stages are designed to be smaller than the diameters of the metal posts 226*b*, 226*f* in the second and sixth stages.

According to this, more than one metal post in each stage is inserted in the dielectric line 220. In relation to the number and diameter of the metal post of each stage, the impedance value of the dielectric resonator of the middle stage is biggest, and each impedance value of the remaining dielectric resonators becomes gradually and symmetrically smaller to both end stages. That is, the number and diameter of the metal posts are determined to have an area that the metal post of each stage cuts the center of the dielectric line 220 should be designed to become gradually smaller to the end layers.

As in the first embodiment, the horizontal distance of the metal post in each stage in the x-axis direction is wider in the middle stage, and they become gradually narrower to both end stages.

The structure of the filter housing 100 and the coupling relationship between the filter 170 and the filter housing is almost same as in the first embodiment. In arranging the tuning screws, it is preferable that the center of each of them and the center of each of the metal posts are aligned.

The three embodiments of the present invention are explained above. However, possible embodiments realizing the basic concept of the present invention are not limited to the above three kinds of embodiments. For instance, the metal posts do not necessarily need to be the cylindrical rod shape, but can have a polygonal rod shape. Further, various changes can be made to the number or diameters of the metal posts, the disposed position of the tuning screws, the shape of the filter housing, or the like.

In comparison with the prior air gap coupling filter, the filter assembly according to this invention has a small loss, a good filter characteristic and a suitable structure for a commercial use due to a superior processing and assembling ability. That is, the difficulty as in the past that each dielectric block is assembled to the filter housing with being cut in an accurate size and with maintaining an accurate distance can be avoided.

According to the metal post filter of the present invention, the filter can be made by simply and accurately forming the inserting holes by injection molding, extrusion molding, or a milling machine in the pre-designed dimensions and positions of the dielectric line which is difficult for being precisely processed, and then by inserting each of the metal posts of the pre-designed dimensions in each of the inserting holes. In particular, by designing the filter to integrally coupled to multi-staged dielectric resonators as a single body, the processing and assembling of the filter can be made simply and precisely and its manufacturing costs can be remarkably reduced. The filter assembly according to the first embodiment has superiority in mass production because the dimensions of the inserting holes and the dimensions of the metal posts are identical.

And also, since the filter assembly of the present invention is designed to minimize the factors of error occurrence during its processing and assembly, the filter can have a preferable filtering characteristic which is intended at the designing stage. The filter assembly can obtain a perfect filter characteristic because even a minute error is completely compensated by adding a tuning screw.

Further, the filter can be easily and accurately assembled to the filter housing. That is, the assembling is completed by interposing the single body type filter in which the metal posts are inserted between the upper and lower conductive plates and by screw-coupling the upper and lower conductive plates. What is more remarkably improved than before is that the filter structure of the millimeter wave band which requires the precision of several microns can be easily assembled without having an extra auxiliary zig.

While the present invention has been particularly shown and described with reference to a particular embodiment thereof, it will be understood by those skilled in the art that various changes and modifications can be made within the scope of the invention as hereinafter claimed. Therefore, all the changes and modifications of which the meaning or scope is equal to the scope of the claims of the present invention belong to the scope of the claims thereof.

What is claimed is:

1. A metal post filter assembly using a non-radiative dielectric waveguide, comprising:

a filter housing which includes parallel conductive plates facing each other; and a filter, disposed between said parallel conductive plates, for filtering a certain frequency band of a traveling electromagnetic wave, said filter including, a single body dielectric line, made from a non-radiative dielectric, whose side surface is formed with a plurality of inserting holes running parallel to said parallel conductive plates, said dielectric line being segmented into multi-stages by one or more sets of said inserting holes which are spaced apart by a predetermined distance along a length direction of said dielectric line, and the number of the sets corresponding to a filtering order of said filter assembly, and a plurality of metal posts, each of which having a diameter to be fittingly inserted in each of said inserting holes, wherein said filter is formed with multi-staged dielectric resonators cascaded as a single body and segmented by said metal posts, said multi-staged dielectric resonators providing a filtering function which selectively allows only the certain frequency band of the traveling electromagnetic wave to pass therethrough by a predetermined impedance coupling relationship.

2. A metal post filter assembly as claimed in claim 1, wherein an impedance of said multi-staged dielectric resonators is largest in a middle stage and becomes gradually and symmetrically smaller to both end stages.

3. A metal post filter assembly as claimed in claim 1, wherein a length of said multi-staged dielectric resonators is longest in a middle stage and becomes gradually and symmetrically shorter to both end stages.

4. A metal post filter assembly as claimed in claim 3, wherein one inserting hole is formed per each stage on the side surface of said dielectric line, said inserting hole in each stage having a diameter which is largest in the middle stage and becomes gradually and symmetrically smaller to both end stages and being disposed along an approximately half-height of said side surface in line.

5. A metal post filter assembly as claimed in claim 3, wherein two inserting holes whose diameters are identical are disposed, per each stage, above and below an approximately half-height point of said side surface of said dielectric line and a vertical distance of said two inserting holes in each stage is narrowest in the middle stage and becomes gradually and symmetrically wider to both end stages.

6. A metal post filter assembly as claimed in claim 3, wherein one or more inserting holes are formed per each stage on said dielectric line, the number of, and diameters of, the inserting holes in each stage being determined in the manner that a reflection rate in each stage against the electromagnetic wave traveling through said dielectric line is highest in the middle stage and becomes gradually and symmetrically lower to both end stages.

7. A metal window filter assembly as claimed in claim 1, further comprising a plurality of tuning screws inserted, parallel to said metal posts toward said dielectric line, through both side walls of said filter housing, for tuning a resonance frequency of the filter by adjusting insertion lengths of said tuning screws.

8. A metal window filter assembly as claimed in claim 7, wherein each of said tuning screws in each stage is disposed in an approximately vertical half-height point of a line in which said sets of said inserting holes is formed.

9. A metal window filter assembly as claimed in claim 1, wherein a wave leakage blocking groove for blocking a leakage of said electromagnetic wave is so formed on a lower surface of an upper conductive plate of, and/or on an upper surface of a lower conductive plate of, said parallel conductive plates as to surround said dielectric line.

10. A metal window filter assembly as claimed in claim 1, wherein an opening is so formed on both flanges of said filter housing as to expose both ports of said dielectric line, a width of said opening being wider than a width of said dielectric line as to provide a marginal space for securing that the ports of said dielectric line are precisely coupled to an input/output port of another device.

11. A metal window filter assembly as claimed in claim 1, wherein said metal posts are formed in a shape of a cylindrical or certain polygonal rod, said rod from the outermost to the center thereof, being made from metal having a superior conductivity.

12. A metal window filter assembly using a non-radiative dielectric waveguide, comprising:

a filter housing including parallel conductive plates facing each other;

a filter, disposed between said parallel conductive plates, for filtering a certain frequency band of a traveling electromagnetic wave therethrough, said filter including a single body dielectric line, made from a non-radiative dielectric, whose side surface is formed with a plurality of inserting holes running parallel to said parallel conductive plates, and a plurality of metal posts, each of which having a diameter to be fittingly inserted in each of said inserting holes, said dielectric line being segmented into multi-stages by one or more sets of said inserting holes which are spaced apart by a predetermined distance along a length direction of said dielectric line, and the number of the sets corresponding to a filtering order of said filter assembly; and a plurality of tuning screws inserted, parallel to said metal posts toward said dielectric line, through both side walls of said filter housing, for tuning a resonance frequency of the filter by adjusting insertion lengths of said tuning screws, wherein said filter is formed with multi-staged dielectric resonators cascaded as a single body and segmented by said metal posts, a length of said multi-staged dielectric resonators is longest in a middle stage and becomes gradually and symmetrically shorter to both end stages, an impedance of said multi-staged dielectric resonators is largest in the middle stage and becomes gradually and symmetrically smaller to both end stages, and said multi-staged dielectric resonators provide a filtering function which selectively allows only the certain frequency band of the traveling electromagnetic wave to pass therethrough.

* * * * *